US005505642A

United States Patent [19]

Theophanides

[11] Patent Number: 5,505,642

[45] Date of Patent: Apr. 9, 1996

[54] NAUTICAL PROPULSION PERFORMANCE ENHANCER

[76] Inventor: Andy E. Theophanides, 4937 Ryandale Rd., Winston-Salem, N.C. 27104

[21] Appl. No.: 423,028

[22] Filed: Apr. 17, 1995

[51] Int. Cl.[6] ..... B63H 1/18

[52] U.S. Cl. ..... 440/66; 440/78

[58] Field of Search ..... 440/49, 66–69, 440/78, 79; 416/179, 244 R, 244 B

[56] References Cited

U.S. PATENT DOCUMENTS 2,355,842 8/1944 Arado ..... 440/71

4,798,547 1/1989 Gearhart ..... 440/66

*Primary Examiner*—Stephen Avila

*Attorney, Agent, or Firm*—Michael I. Kroll

[57] ABSTRACT

A nautical propulsion performance enhancer for a propeller of a marine propeller type propulsion system, comprising a facility for twisting and directing a flow of water into the propeller, in such a manner that swirling water will hit the propeller in a direction opposite to rotation of the propeller. A structure is for mounting the twisting and directing facility to the marine propeller type propulsion system adjacent the propeller, in order to overcome unwanted effects of cavitation and porpoising.

1 Claim, 4 Drawing Sheets

NAUTICAL PROPULSION PERFORMANCE ENHANCER

BACKGROUND OF THE INVENTION

1. Field of the Invention

The instant invention relates generally to marine propeller type propulsion systems and more specifically it relates to a nautical propulsion performance enhancer.

2. Description of the Prior Art

The two bigger problems that reduce the efficiency of marine propeller type propulsion systems are cavitation and porpoising. Cavitation is the sudden formation and collapse of low pressure bubbles in liquids by means of mechanical forces, as those resulting from rotation of a marine propeller. Slicing into air bubbles rather than into water greatly reduces thrust. Porpoising refers to the oscillating symmetrical movements of a seaplane, flying-boat, or amphibian, when planing pitching instability on the water, as distinct from instability under airborne conditions. Hitherto, these factors have greatly reduced the efficiency of the marine propeller type propulsion systems, causing such unwanted effects as reducing horsepower and speed, while producing excessive vibration of the propeller as it slices through the water.

SUMMARY OF THE INVENTION

In order to overcome the unwanted effects of cavitation and porpoising, the instant invention, which is a nautical propulsion performance enhancer provides fins on each side of a marine propeller type propulsion system of a boat. The fins twist and direct the flow of water into a propeller, in such a manner that the swirling water hits the propeller in a direction opposite to the rotation of the propeller.

A primary object of the present invention is to provide a nautical propulsion performance enhancer that will overcome the hitherto unresolved effects of cavitation and porpoising.

Another object is to provide a nautical propulsion performance enhancer that is designed to allow a boat engine to achieve up to at least thirty percent more revolutions per minute during its operation within the water.

An additional object is to provide a nautical propulsion performance enhancer which will increase speed and relieve a load from the propeller.

A further object is to provide a nautical propulsion performance enhancer that is simple and easy to use.

A still further object is to provide a nautical propulsion performance enhancer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
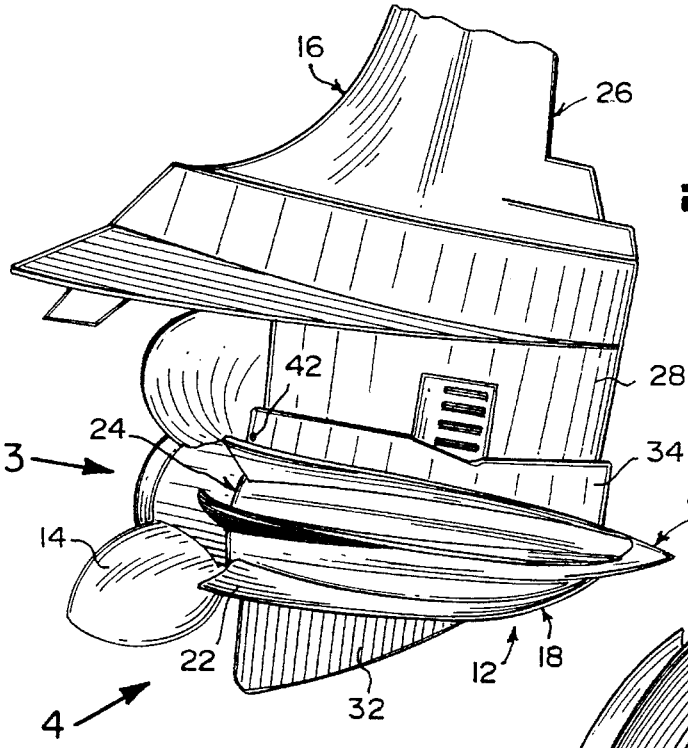
FIG. 1 is a front right side perspective view of a first embodiment of the instant invention installed onto a gear drive housing of an outboard/outdrive engine of a boat.
Figure 2:
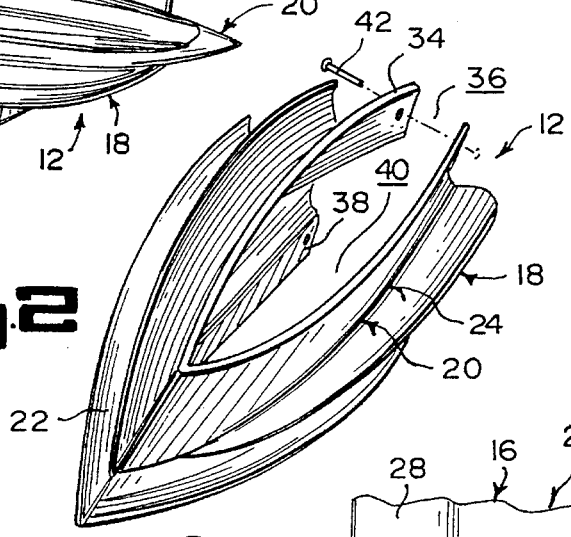
FIG. 2 is a front top perspective view of the first embodiment per se taken in the direction of arrow 2 in FIG. 1.
Figure 3:
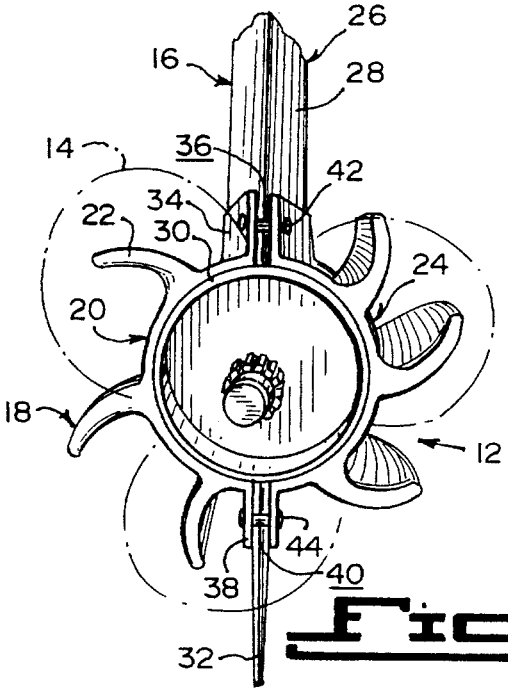
FIG. 3 is a rear perspective view taken in the direction of arrow 3 in FIG. 1, showing the propeller in phantom.
Figure 4:
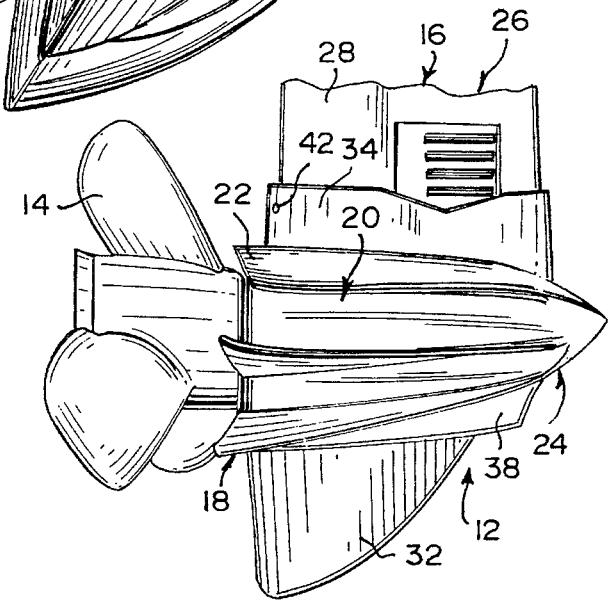
FIG. 4 is a right side elevational view taken in the direction of arrow 4 in FIG. 1.

Turning now descriptively to the drawings, in which similar reference characters denote similar elements throughout the several views, FIGS. 1 through 11 illustrate a nautical propulsion performance enhancer 12 for a propeller 14 of a marine propeller type propulsion system 16, comprising a facility 18 for twisting and directing a flow of water into the propeller 14, in such a manner that swirling water will hit the propeller 14 in a direction opposite to rotation of the propeller 14. A structure 20 is for mounting the twisting and directing facility 18 to the marine propeller type propulsion system 16 adjacent the propeller 14, in order to overcome unwanted effects of cavitation and porpoising.

The twisting and directing facility 18 includes a plurality of stationary curved fins 22 radially positioned about the mounting structure 20. Each fin 22 starts at a narrow end from a leading edge of the mounting structure 20, extends back towards the propeller 14 to a trailing edge of the mounting structure 20 at a wide end and is gradually pitched at an angle in a clockwise/counterclockwise direction, being opposite in direction of rotation of the propeller 14. The mounting structure is a casing 24. The fins 22 are integral with and radially project from the casing 24.

The marine propeller type propulsion system 16 in Figures, 2, 3, 4, 9, 10 and 11 are in the outboard/outdrive engine 26, having a lower housing unit 28, a gear drive housing 30 and a skeg 32. The term outboard engine defines the outboard/outdrive engine in all occurences. The casing 24 includes a pair of upper extending flanges 34 having a first longitudinal slot 36 therebetween extending inwardly from the trailing edge. A pair of lower extending flanges 38 have a second longitudinal slot 40 therebetween extending inwardly from the trailing edge. The casing 24 can fit over the gear drive housing 30, with the upper extending flanges 34 on both sides of the lower housing unit 28 and the lower extending flanges 38 on both sides of the skeg 32.

An upper fastener 42 is for holding free ends of the upper extending flanges 34 together at the trailing edge on the lower housing unit 28. A lower fastener 44 is for holding free ends of the lower extending flanges 38 together at the trailing edge on the skeg 32. The fins 22 are six in number, which extend radially about the casing 24, to help swirl the water in the opposite direction before reaching the propeller 14.

Figure 5:
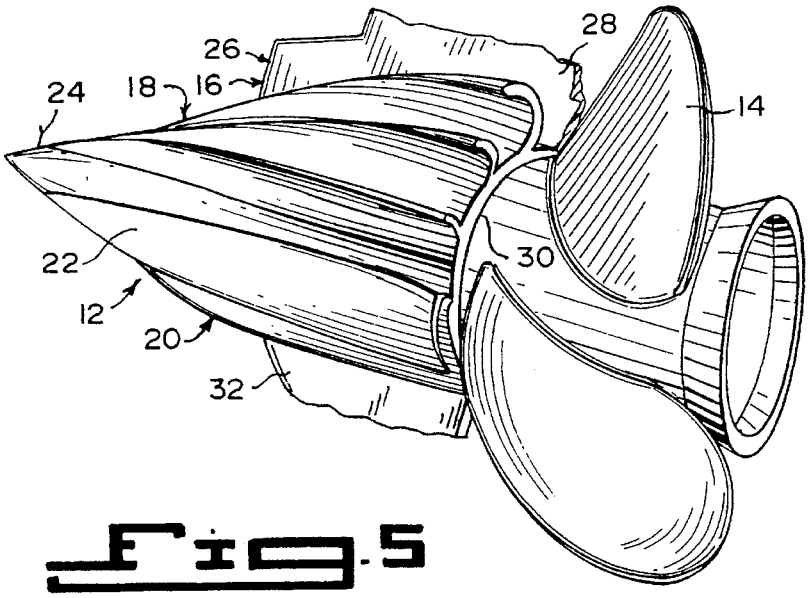
FIG. 5 is a rear left side perspective view of a second embodiment of the instant invention formed about and integral with the gear driving housing of the outboard/outdrive engine.

In FIG. 5, the marine propeller type propulsion system 16 is the outboard/outdrive engine 26 having the lower housing unit 28, the gear drive housing 30 and the skeg 32. The casing 24 is integrally formed to and about the gear drive housing 30. The fins 22 are eight in number, which extend radially about the casing 24, to swirl the water in the opposite direction before reaching the propeller 14.

Figure 6:
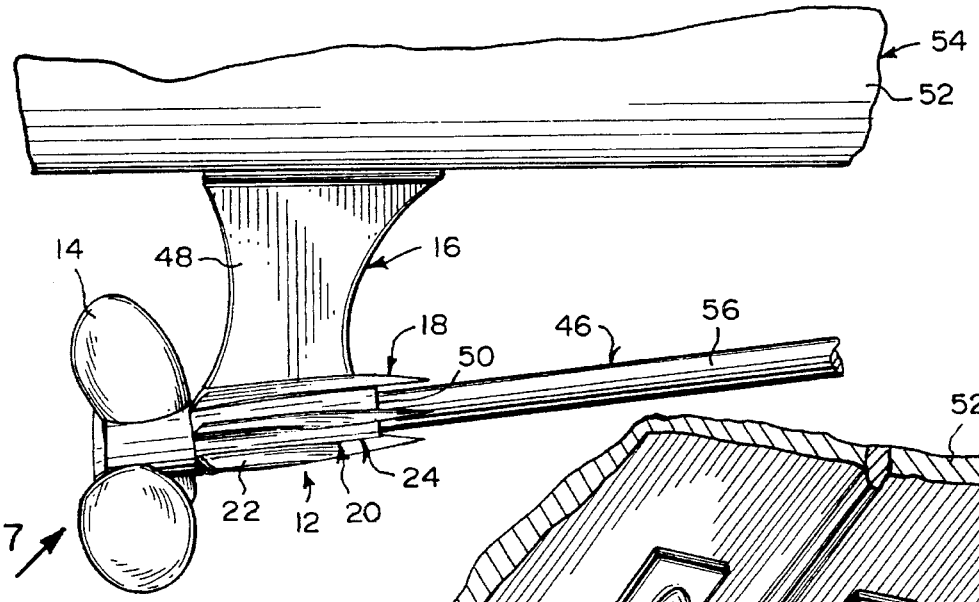
FIG. 6 is a right side elevational view of a third embodiment of the instant invention formed about and integral with a vee strut of a straight inboard engine of a boat.
Figure 7:
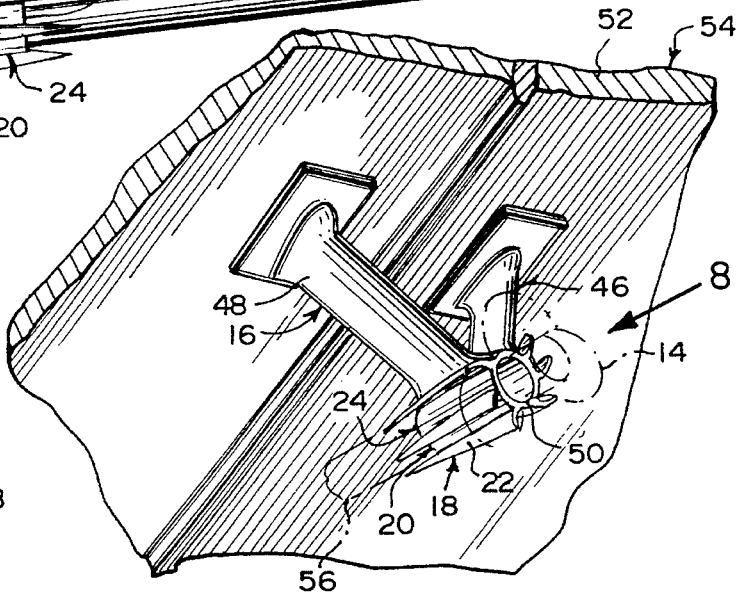
FIG. 7 is a bottom left side perspective view taken in the direction of arrow 7 in FIG. 6, showing the propeller and drive shaft in phantom.
Figure 8:
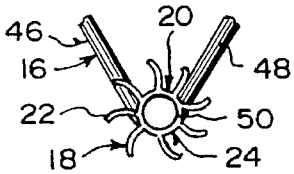
FIG. 8 is a rear elevational view taken in the direction of arrow 8 in FIG. 7 with parts broken away.

The marine propeller type propulsion system 16, in FIGS. 6, 7 and 8, is an inboard engine 46 having a vee strut 48 with a sleeve 50 mounted to the underside of a hull 52 of a boat 54. The sleeve 50 rotatively carries a drive shaft 56 for the propeller 14. The casing 24 is integrally formed to and about the sleeve 50 of the vee strut 48. The fins 22 are eight in number, which extend radially about the casing 24 to swirl the water in the opposite direction before reaching the propeller 14.

Figure 10:
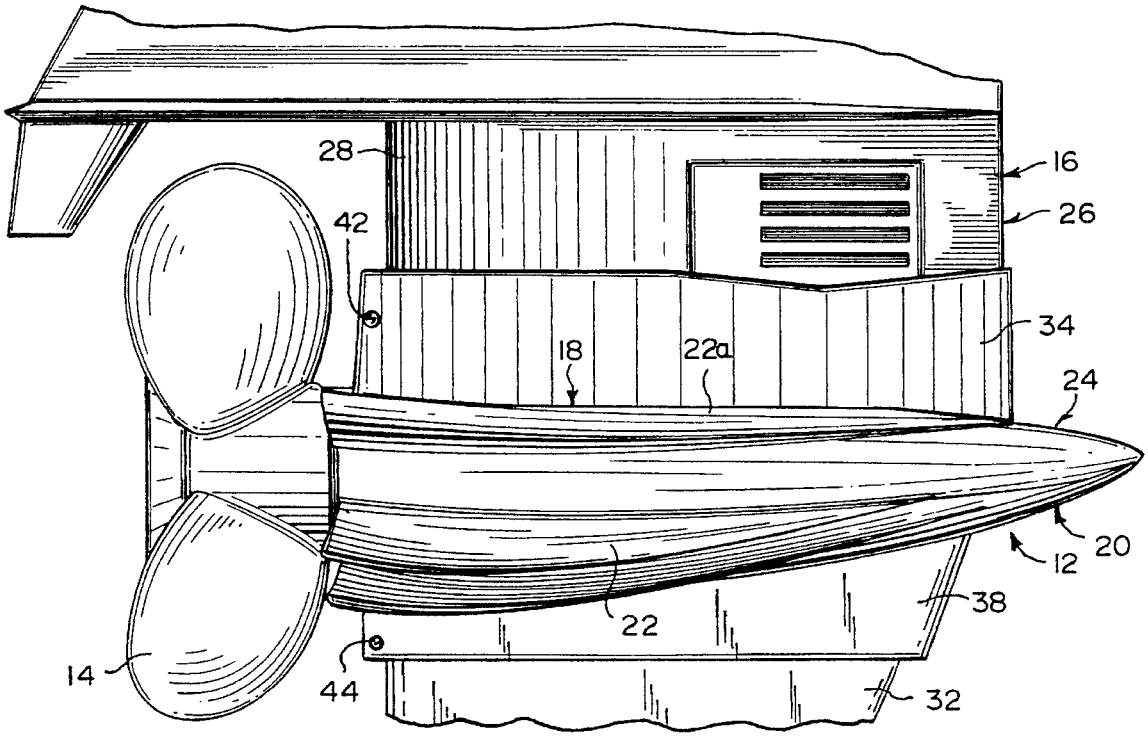
FIG. 10 is a right side elevational view taken in the direction of arrow 10 in FIG. 9, with the propeller replaced thereon.
Figure 9:
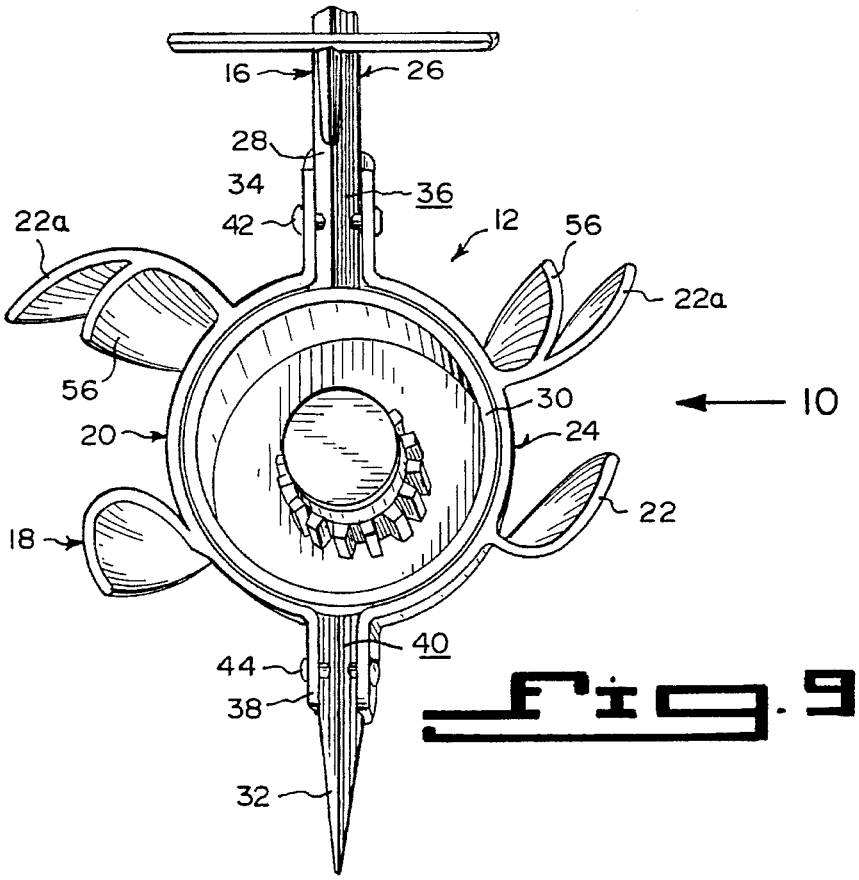
FIG. 9 is a rear perspective view of a fourth embodiment of the instant invention installed onto a gear drive housing of an outboard/outdrive engine, with the propeller removed therefrom.
Figure 11:
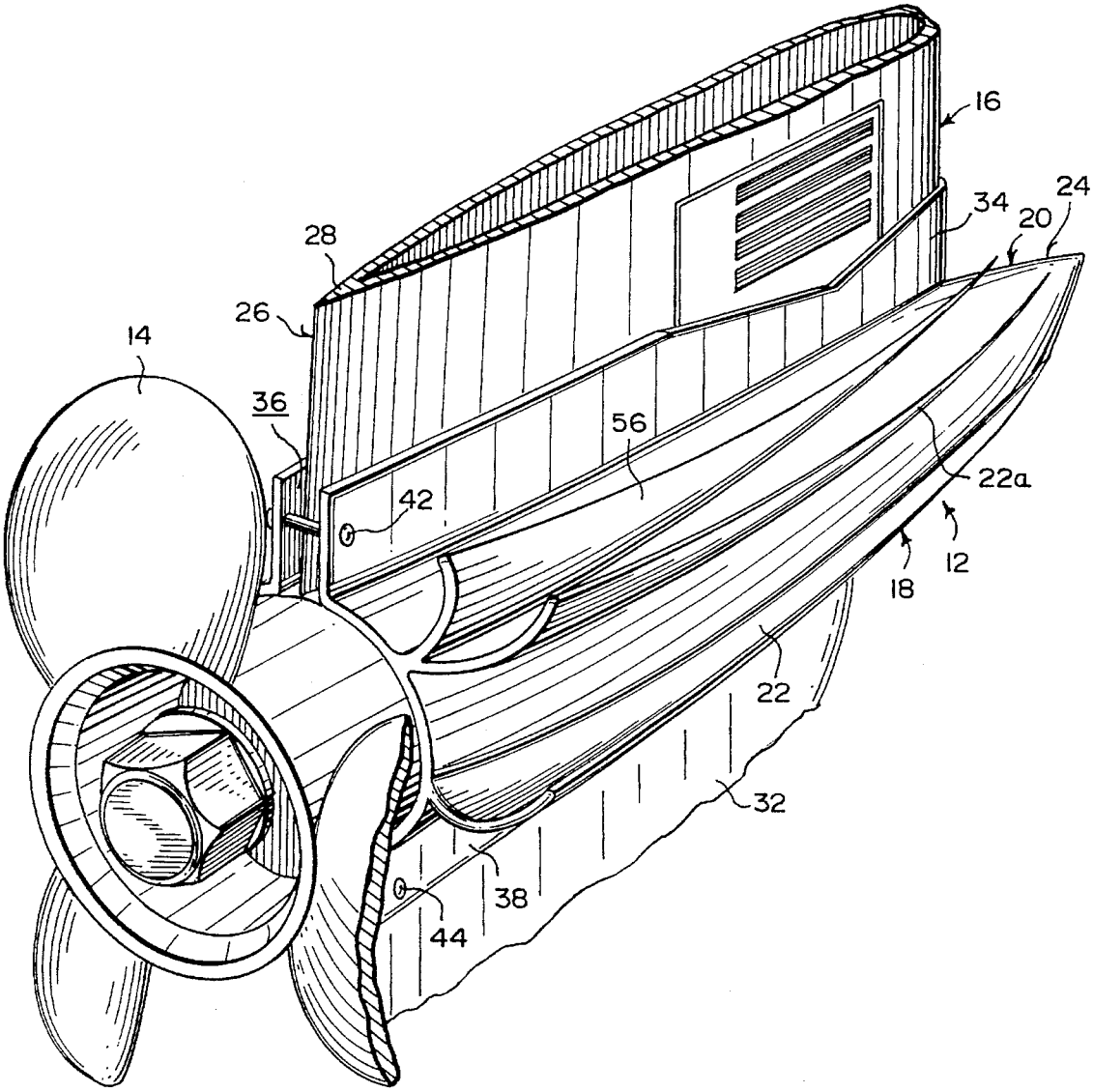
FIG. 11 is a rear right side perspective view taken in the direction of arrow 10 in FIG. 9.

In FIGS. 9, 10 and 11, the fins 22 are four in number, which extend radially about the casing 24 to swirl the water in the opposite direction before reaching the propeller 14. Each upper fin 22a includes an inner curved blade 56 extending therealong, to help increase the swirling action of the water.

LIST OF REFERENCE NUMBERS

12 nautical propulsion performance enhancer
14 propeller
16 marine propeller type propulsion system
18 twisting and directing facility
20 mounting structure for 18 on 16
22 curved fin of 18
22*a* upper fin
24 casing for 20
26 outboard/outdrive engine for 16
28 lower housing unit of 26
30 gear drive housing of 26
32 skeg of 26
34 upper extending flange of 24
36 first longitudinal slot in 24
38 lower extending flange of 24
40 second longitudinal slot in 24
42 upper fastener
44 lower fastener
46 inboard engine for 16
48 vee strut
50 sleeve on 48
52 hull
54 boat
56 inner curved blade on 22*a*

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A nautical propulsion performance enhancer for a propeller of a marine propeller type propulsion system, said propeller having vanes and being mounted trailing edge of a gear drive housing, comprising:

a) means for twisting and directing a flow of water into the propeller, in such a manner that swirling water will hit the propeller in a direction opposite to rotation of the propellers, said twisting and directing means comprising a member split into two side sections joined the front ends and extending rearwardly and apart from each other, each section having flow vanes extending the full length of said side sections; and b) said twisting and directing means being mounted on said gear drive housing with the front of said twisting and directing means at and straddling the leading edge of said gear drive housing with said side sections extending back on opposite sides of said gear drive housing toward said trailing edge, each of said sections having upper and lower flanges and means for joining the rear ends of said flanges adjacent said propeller to secure said sections in place, said flow vanes gradually pitched from front to rear so as to direct water flow against said propeller vanes in opposite direction to the direction of rotation of said propeller in order to overcome unwanted effects of cavitation and porposising.

* * * * *